US010276985B1

(12) United States Patent
Liu et al.

(10) Patent No.: US 10,276,985 B1
(45) Date of Patent: Apr. 30, 2019

(54) HIGH-SPEED PLUG-IN CARD CONNECTOR

(71) Applicant: Amphenol Commercial Products (ChengDu) Co. LTD, Chengdu (CN)

(72) Inventors: Xiaogang Liu, Shenzhen (CN); Rongzhe Guo, Chengdu (CN); Lei Liao, Shenzhen (CN)

(73) Assignee: AMPHENOL COMMERCIAL PRODUCTS (CHENGDU)) CO. LTD, Chengdu (CN)

( * ) Notice: Subject to any disclaimer, the term of this patent is extended or adjusted under 35 U.S.C. 154(b) by 0 days.

(21) Appl. No.: 15/884,274

(22) Filed: Jan. 30, 2018

(30) Foreign Application Priority Data

Nov. 30, 2017 (CN) ..... 2017 2 1648145

(51) Int. Cl.

| | |
|---|---|
| ***H01R 13/658*** | (2011.01) |
| ***H01R 13/6587*** | (2011.01) |
| ***H01R 13/26*** | (2006.01) |
| ***H01R 12/72*** | (2011.01) |
| ***H01R 13/11*** | (2006.01) |
| ***H01R 13/6596*** | (2011.01) |
| ***H01R 12/73*** | (2011.01) |
| ***H01R 13/6597*** | (2011.01) |
| *H01R 24/62* | (2011.01) |

(52) U.S. Cl.
CPC ..... *H01R 13/6587* (2013.01); *H01R 12/721* (2013.01); *H01R 12/737* (2013.01); *H01R 13/113* (2013.01); *H01R 13/26* (2013.01); *H01R 13/6596* (2013.01); *H01R 13/6597* (2013.01); *H01R 24/62* (2013.01)

(58) Field of Classification Search
CPC ..... H01R 13/6587
USPC ..... 439/637
See application file for complete search history.

(56) References Cited

U.S. PATENT DOCUMENTS

| | | | | |
|---|---|---|---|---|
| 4,026,014 | A * | 5/1977 | Sugimoto | H01R 12/737 29/884 |
| 4,795,374 | A * | 1/1989 | Rishworth | H01R 12/716 439/634 |
| 6,152,742 | A * | 11/2000 | Cohen | H01R 13/502 439/60 |
| 6,394,823 | B1 * | 5/2002 | Dunham | H01R 12/721 439/108 |
| 6,592,407 | B2 * | 7/2003 | Korunsky | H01R 12/716 439/108 |
| 6,688,897 | B2 * | 2/2004 | Korsunsky | H05K 1/117 439/108 |
| 7,014,516 | B2 * | 3/2006 | Yang | H01R 13/187 439/170 |

(Continued)

*Primary Examiner* — Ross N Gushi
(74) *Attorney, Agent, or Firm* — Gokalp Bayramoglu

(57) ABSTRACT

A high-speed plug-in card connector comprising two terminal assemblies with reversely arranged internal structure and a housing. Each terminal assembly includes a metal sheet, a conductive plastic, and an injection-molded terminal strip. The conductive plastic is formed on the side of the metal sheet by injection molding and connects the metal sheet with a ground terminal of the terminal strip. The conductive plastics of the two terminal assemblies are located in the very middle of the connector. The conductive plastics fix the two terminal assemblies together with a snap-in connection. The housing is clamped at the end on the side where the two terminal assemblies are snapped together.

5 Claims, 4 Drawing Sheets

(56) References Cited

U.S. PATENT DOCUMENTS 7,048,585 B2 * 5/2006 Milbrand, Jr. ..... H01R 23/688 439/108
8,636,548 B2 * 1/2014 Fu ..... H01R 27/00 439/637
9,537,239 B1 * 1/2017 Liu ..... H01R 12/7076
10,020,603 B1 * 7/2018 Liu ..... H01R 12/7088
2002/0031953 A1 * 3/2002 Hashimoto ..... H05K 7/1431 439/637
2002/0119704 A1 * 8/2002 Ito ..... H01R 12/721 439/636
2003/0186590 A1 * 10/2003 Nishiyama ..... H01R 12/7005 439/637
2007/0155245 A1 * 7/2007 Tsai ..... H01R 12/7005 439/637
2010/0317234 A1 * 12/2010 Yao ..... H01R 12/716 439/637
2012/0088375 A1 * 4/2012 Fu ..... H01R 12/716 439/62
2013/0217263 A1 * 8/2013 Pan ..... H01R 13/6474 439/607.07
2016/0308309 A1 * 10/2016 Stokoe ..... H01R 13/6586
2016/0365654 A1 * 12/2016 Wormsbecher .... H01R 12/7076
2017/0187134 A1 * 6/2017 Boyd ..... H01R 12/721
2017/0187157 A1 * 6/2017 Hsu ..... H01R 12/7005
2017/0244183 A1 * 8/2017 Moriyasu ..... H01R 12/7005
2018/0019542 A1 * 1/2018 Cai ..... H01R 12/721
2018/0026384 A1 * 1/2018 Shibuya ..... H01R 12/737 439/637
2018/0034177 A1 * 2/2018 Enomoto ..... H01R 12/721
2018/0040992 A1 * 2/2018 Wang ..... H01R 12/7005
2018/0054009 A1 * 2/2018 Wang ..... H01R 12/58
2018/0076560 A1 * 3/2018 Tang ..... H01R 12/714
2018/0090864 A1 * 3/2018 Niu ..... H01R 12/721
2018/0212362 A1 * 7/2018 Wang ..... H01R 12/7029
2018/0254571 A1 * 9/2018 Herring ..... H01R 12/721

* cited by examiner

HIGH-SPEED PLUG-IN CARD CONNECTOR

CROSS REFERENCE TO RELATED APPLICATIONS

This application is based upon and claims priority to Chinese Patent Application No. CN2017216481458, filed on Dec. 1, 2017, the entire contents of which are incorporated herein by reference.

TECHNICAL FIELD

The present invention relates to signal/power transmission devices, and particularly to a high-speed plug-in card connector.

BACKGROUND OF THE INVENTION

Presently, for signal transmission, two connectors are respectively connected to two circuit boards and then docked together to achieve signal transmission between the two circuit boards. Besides, in the market, the method in which the signal transmission is achieved by an orthogonal connector respectively connected to two circuit boards is also available. Both methods have their advantages in terms of signal transmission. However, both methods have a common defect of poor shielding performance during signal transmission.

SUMMARY OF THE INVENTION

Regarding the above shortcomings of the prior art, the present invention provides a high-speed plug-in card connector with good shielding performance.

In order to achieve the above purpose of the invention, the following technical solution is used:

A high-speed plug-in card connector is provided, comprising two terminal assemblies with reversely arranged internal structure and a housing. Each terminal assembly includes a metal sheet, a conductive plastic, and an injection-molded terminal strip.

The conductive plastic is formed on the side of the metal sheet by injection molding and connects the metal sheet with the ground terminal of the terminal strip.

The conductive plastics of the two terminal assemblies are located in the very middle of the connector. The conductive plastics fix the two terminal assemblies together with a snap-in connection. The housing is clamped at the end on the side where the two terminal assemblies are snapped together.

Further, a bar-shaped groove is provided recessively on the free end of the housing to receive the electronic card. Metal snap joints are provided on both upper and lower ends of the bar-shaped groove.

Further, the metal snap joint is wrapped around the side wall of the bar-shaped groove in the width direction.

Further, the terminal strip includes a plurality of terminals and plastic shells wrapped outside the plurality of terminals by injection molding.

Further, at least one snap joint is provided on one piece of the conductive plastics, and a positioning groove matched with the snap is provided on the other piece of the conductive plastics, and the snap and the positioning groove can achieve the snap connection.

The advantages of the present invention are as follows. The metal sheet contacting the terminal strip and the conductive plastic can act as a shield. The plastic shell is wrapped around the plurality of terminals by injection molding, thereby improving the SI performance of the plug-in card connector. After the conductive plastic is formed on one side of the metal sheet by injection molding, since the terminal strip and the metal sheet can be fixedly connected through the conductive plastic, the contact between the metal sheet and the ground terminal of the terminal strip is more reliable, and the high-speed performance is more stable.

The present invention uses the injection molding method to improve the assembling accuracy of each component inside the connector. Meanwhile, the assembly time of manual assembly line can be reduced. Thus, the production efficiency of the connector is improved. The provided metal snap joint can prevent offset or signal interruption of the electronic card, caused by the wear and tear of the housing while inserting the card. Thus, the signal transmission and the high-speed SI performance of the connector are improved. Meanwhile, through the proper installation of the metal snap joint, the problems, like the main body of the connector get skewed due to violent insertion of the card, and the performance of signal transmission gets affected, can be effectively avoided

Figure 1:
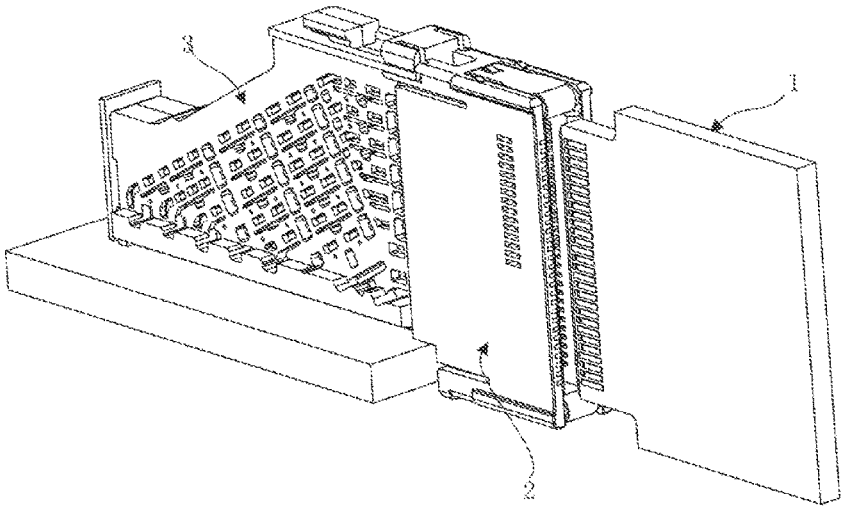
FIG. 1 is a diagram of the using state of the high-speed plug-in card connector.

In the drawings, 1, electronic card; 2, housing; 21, side wall; 22, bar-shaped groove; 23, terminal groove; 3, terminal assembly; 31, terminal strip; 311, plastic shell; 312, terminal; 3121, contact part; 3122, ground terminal; 32, metal sheet; 33, conductive plastic; 331, snap joint; 332, positioning groove; 4, metal snap joint.

DETAILED DESCRIPTION OF THE INVENTION

Specific embodiments of the present invention will be described below so as to facilitate those skilled in the art to understand the present invention. However, it should be clear that the present invention is not limited to the scope of the specific embodiments. To those of ordinary skill in the art, various changes made within the spirit and scope of the invention as defined and determined by appended claims are deemed as apparent. All inventions that use the inventive concept of the present invention should be deemed as within the protective scope of the present invention.

As shown in FIG. 1, the high-speed plug-in card connector includes housing 2 and two terminal assemblies 3 with reversely arranged internal structure.

Figure 6:
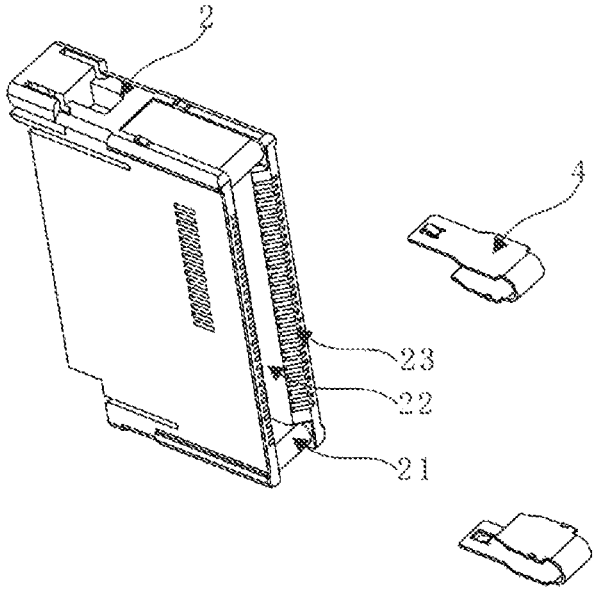
FIG. 6 is an assembly diagram of the housing and the metal snap joint.

The housing 2 is clamped at the end on the side where the two terminal assemblies 3 are snapped together. A bar-shaped groove 22 is provided recessively at the free end of the housing 2 to receive the electronic card. A contact part 3121 on one side of terminal strip 31 is provided inside terminal groove 23 and extends into the bar-shaped groove 22. Referring to FIG. 6, metal snap joints 4 are provided on both upper and lower ends of the bar-shaped groove 22.

During implementation, preferably, the metal snap joint 4 is wrapped around the side wall of the bar-shaped groove 22 in the width direction.

The provided metal snap joint 4 can prevent offset in the electronic card 1, caused by the wear and tear of the housing 2 while inserting the card. Thus, the signal transmission and the high-speed SI performance of the connector are improved. Meanwhile, through the proper installation of the metal snap joint 4, the problems, like the main body of the connector get skewed due to violent insertion of the card, and the performance of signal transmission gets affected, can be effectively avoided.

Figure 4:
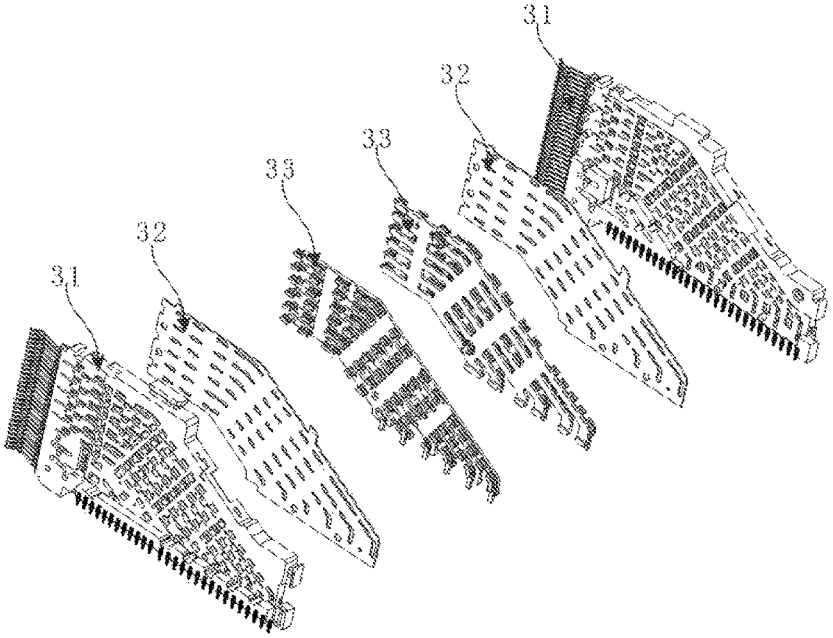
FIG. 4 is an exploded view of the high-speed plug-in card connector without a housing.

As shown in FIG. 4, the terminal assembly 3 includes a metal sheet 32, a conductive plastic 33 and an injection-molded terminal strip 31. The conductive plastic 33 is formed on one side of the metal sheet 32 by injection molding and connects the metal sheet 32 and the ground terminal 3122 of the terminal strip 31.

Figure 7:
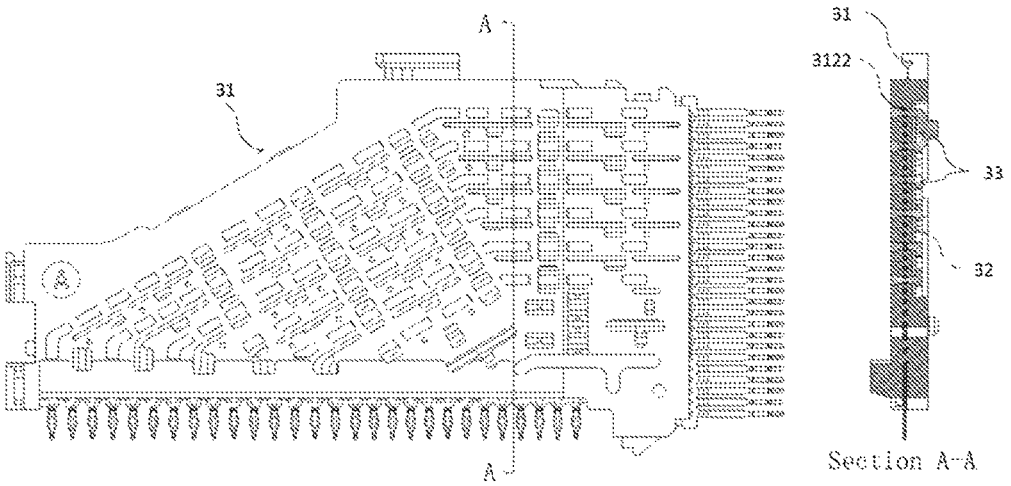
FIG. 7 is a schematic diagram showing a connection among the metal sheet, the conductive plastic and the terminal strip.

As shown in FIG. 7, the conductive plastic 33 formed by injection molding can make the contact between the metal sheet 32 and the ground terminal 3122 of the terminal strip 31 more reliable and the high-speed performance more stable.

The metal sheet 32 is configured to make the metal sheet 32 conductive to the ground terminal 3122 of the terminal strip 31 and make the conductive plastic 33 conductive to the metal sheet 32. In this way, the shielding performance of the plug-in card connector can be improved, thereby ensuring the stability of the SI performance of the plug-in card connector.

Figure 2:
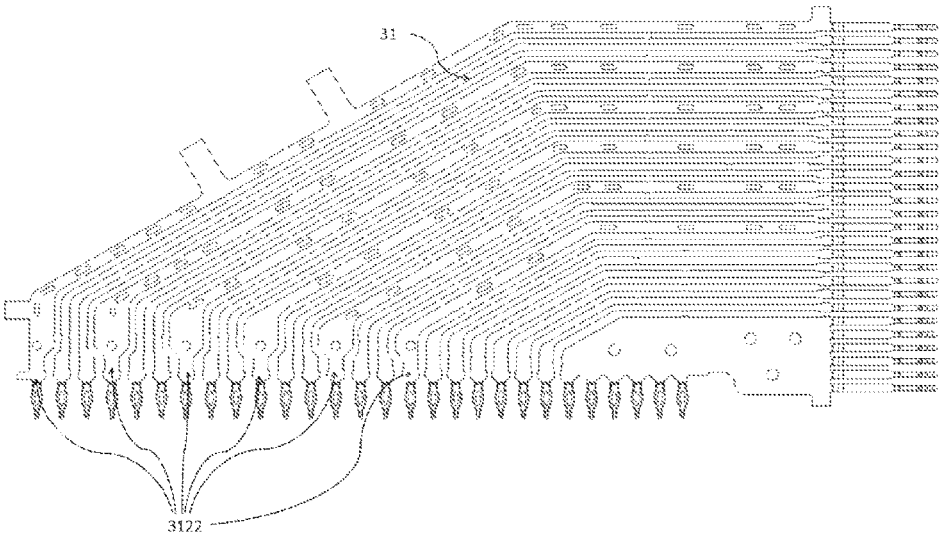
FIG. 2 is a schematic diagram of the structure of a plurality of terminals provided side by side.
Figure 3:
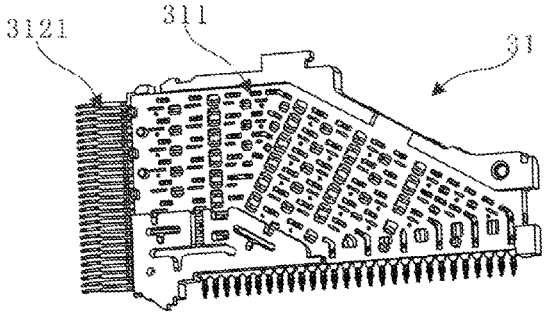
FIG. 3 is a three-dimensional diagram of the terminal strip.

As shown in FIG. 2 and FIG. 3, the terminal strip 31 includes plurality of terminals 312 and plastic shell 311 wrapped outside the terminals 312 by injection-molding. A contact part 3121 is formed by an extension part of the plurality of terminals 312 outside the plastic shell 311. The plastic shell 311 is wrapped around the terminals 312 by injection molding, such that the SI performance of the entire plug-in card connector can be improved.

As shown in FIG. 4, the conductive plastics 33 of the two terminal assemblies 3 are located in the very middle of the connector. Moreover, the two conductive plastics 33 fix the two terminal assemblies together with a snap-in connection.

Figure 5:
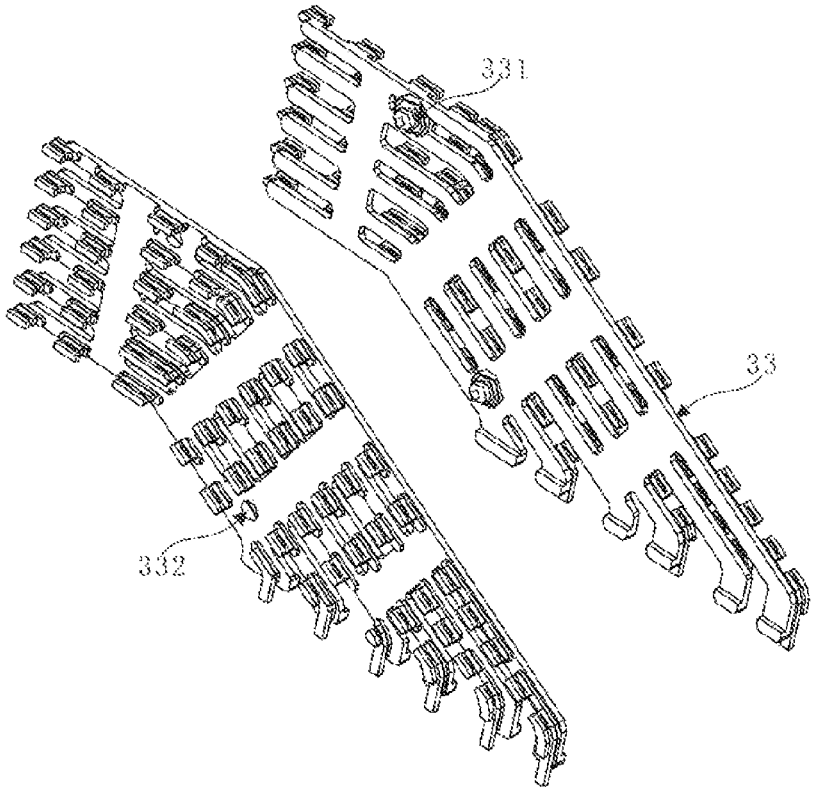
FIG. 5 is an assembly diagram of the two pieces of conductive plastics.

As shown in FIG. 5, during implementation, preferably, the present invention provides at least one snap joint 331 on one piece of conductive plastic 33 of two pieces of conductive plastic 33. A positioning groove 332 which matches the snap joint 331 is provided on the other piece of conductive plastic 33. The snap joint 331 and the positioning groove 332 form the snap-in connection.

Combining the two pieces of conductive plastics 33 in this way can make the two pieces of metal sheet 32 conductive to each other and make the conductive plastic 33 conductive to the metal sheet 32, thereby achieving the complete connection to the ground so as to optimize the shielding performance.

Stainless steel can be selected as the material of the metal sheet 32. The selection of the material of the metal sheet 32 and the conductive plastic 33 can reduce the production cost of the plug-in card connector. In addition, using stainless steel as the metal sheet 32 can also improve the strength of the metal sheet 32.

In summary, the connector of the present invention achieves the assembly of some components by providing the metal sheet 32 and the two-shot injection molding. Thus, the SI performance of the connector can be improved, and the shielding performance of the connector is ensured at the same time.

We claim:

1. A high-speed plug-in card connector, comprising:

two terminal assemblies with reversely arranged internal structure, and a housing;

wherein each terminal assembly includes a metal sheet, a conductive plastic, and an injection-molded terminal strip;

the conductive plastic is formed on a side of the metal sheet by injection molding, and the conductive plastic connects the metal sheet to a ground terminal of the terminal strip;

the conductive plastics of the two terminal assemblies are located in the very middle of the connector;

the conductive plastics fix the two terminal assemblies together with a snap-in connection;

the housing is clamped at an end of a side of the two terminal assemblies that snap together.

2. The high-speed plug-in card connector according to claim 1, wherein a bar-shaped groove is provided recessively at a free end of the housing to receive an electronic card; and metal snap joints are provided on both upper and lower ends of the bar-shaped groove.

3. The high-speed plug-in card connector according to claim 2, wherein the metal snap joint is wrapped around a side wall of the bar-shaped groove in a width direction.

4. The high-speed plug-in card connector according to claim 1, wherein the terminal strip includes a plurality of terminals and a plastic shell wrapped outside the plurality of terminals by injection molding.

5. The high-speed plug-in card connector according to claim 1, wherein at least one snap joint is provided on one piece of the conductive plastics, and a positioning groove matching the snap joint is provided on the other piece of the conductive plastics, and the snap joint and the positioning groove form a snap-in connection.

* * * * *